US006832910B2

(12) United States Patent
Chung

(10) Patent No.: US 6,832,910 B2
(45) Date of Patent: Dec. 21, 2004

(54) PIEZOELECTRIC LIGHTER WITH IMPROVED SAFETY

(75) Inventor: Aman Kai man Chung, Hong Kong (CN)

(73) Assignee: Pollyconcept Holding SA, Sucy-en-Brie (FR)

( * ) Notice: Subject to any disclaimer, the term of this patent is extended or adjusted under 35 U.S.C. 154(b) by 0 days.

(21) Appl. No.: 10/182,920

(22) PCT Filed: Feb. 2, 2001

(86) PCT No.: PCT/FR01/00328

§ 371 (c)(1),
(2), (4) Date: Dec. 3, 2002

(87) PCT Pub. No.: WO01/57443

PCT Pub. Date: Aug. 9, 2001

(65) Prior Publication Data

US 2003/0143504 A1 Jul. 31, 2003

(30) Foreign Application Priority Data

Feb. 4, 2000 (FR) ..... 00 01444

(51) Int. Cl.[7] ..... F23D 11/36
(52) U.S. Cl. ..... 431/153; 431/255
(58) Field of Search ..... 431/153, 255

(56) References Cited

U.S. PATENT DOCUMENTS 4,904,180 A * 2/1990 Nitta ..... 431/153
5,788,476 A 8/1998 Sher
6,010,328 A * 1/2000 Sung ..... 431/153
6,095,796 A * 8/2000 Sung ..... 431/153
6,575,735 B1 * 6/2003 Lloveras Capilla ..... 431/153

FOREIGN PATENT DOCUMENTS

WO WO 99/46539 9/1999

* cited by examiner

*Primary Examiner*—Alfred Basichas
(74) *Attorney, Agent, or Firm*—Young & Thompson

(57) ABSTRACT

A piezoelectric lighter includes a flame-generating device (30) including a gas jet releasing mechanism (36) and spark-generating mechanism piezoelectric mechanism (50). The lighter includes two actuating elements (32, 34; 140, 150, 170, 180; 210, 220; 240, 250) capable of moving along a longitudinal axis (XX') under the action of a force exerted by the user, at least one (32; 140; 170; 210; 240) of the actuating elements, called first actuating element, being capable of moving independently of the second actuating element (34; 150; 180; 220; 250) and to act on at least on one (50) of the mechanisms, called first mechanism, the second actuating element being adapted to act on the second mechanism (36).

18 Claims, 8 Drawing Sheets

PIEZOELECTRIC LIGHTER WITH IMPROVED SAFETY

BACKGROUND OF THE INVENTION

The invention relates to a piezoelectric-type lighter containing a flame-generation device which contains a mechanism releasing a jet of gas and a piezoelectric spark-generation mechanism.

A piezoelectric lighter of the type mentioned above is known from document U.S. Pat. No. 5,145,358, in which a safety mechanism has been inserted in order to prevent unintended users, such as children, from causing a flame to ignite and thereby running the risk of injuring themselves or causing injuries to others.

In this document, the safety mechanism consists of a safety organ co-operating with a stop which is integral with the lighter when the safety mechanism is placed in what is called a locked position.

When the normal user of the lighter wishes to use the latter, he must shift the safety mechanism from the locked position to an unlocked position.

To do this, when the lighter is placed in a vertical position, the user must carry out a translation horizontal to the safety organ, thus removing it from the stop, and, at the end of the translation, must press on an actuator in a downward vertical direction in order to trigger the mechanism releasing a jet of gas and the piezoelectric spark-generation mechanism in order to cause a flame to ignite.

However, this solution, although relatively satisfactory as regards the difficulty of operation for an unauthorized user, can prove tiresome for those who use the lighter daily.

In view of the above, the applicant set out to design a novel lighter which is easier to use for a normal user than is the lighter of the state of the art mentioned above, but nevertheless offers a certain degree of safety as regards the use of this lighter by unauthorized users such as children.

SUMMARY OF THE INVENTION

The present invention thus proposes a piezoelectric-type lighter including a flame-generation device which includes a mechanism releasing a jet of gas and a piezoelectric spark-generation mechanism, wherein the said lighter includes two actuators capable of moving along a longitudinal axis XX' under the action of a force exerted by a user, at least one of the said actuators, called first actuator, being capable of moving independently of the second actuator and of acting at least on one of the said mechanisms, called first mechanism, the said second actuator being capable of acting at least on the second mechanism.

Thus, according to the invention, in order to operate the lighter, the normal user of the lighter will not have to perform a movement fundamentally different from that performed with standard lighters for which he exerts a downward vertical pressure on the actuator of these latter with the help of his thumb.

On the contrary, given that the figures of an unintended user such as a child are smaller than those of a normal user, who is generally an adult, it will be difficult for the child to operate the lighter by pressing simultaneously on the two actuators.

Moreover, given that at least one of the two actuators is capable of moving independently of the other actuator, if the child presses on only one of the two actuators, the chances of his being able to operate the lighter are one in two, which does after all offer a degree of safety.

According to a feature, the first actuator rests on the first mechanism, which is the spark-generation mechanism, and thus acts directly on the latter.

According to another feature, the second actuator acting on the second mechanism, which is the mechanism releasing a jet of gas, includes at least one part which rests on a piece forming a lever and which permits, under the action of a force along longitudinal axis XX', the release of a jet of gas.

According to yet another feature, the two actuators are independent of each other in their axial movement.

In a first embodiment, the second actuator is also capable of acting on the first mechanism, the two actuators being able or not to be independent of each other in their axial movement.

Thus, it is sufficient for the authorized user of the lighter to press only on the second actuator in order to act at one and the same time on the first and on the second mechanism.

Moreover, according to a feature linked to the preceding one, the second actuator rests on the first mechanism, which is the spark-generation mechanism, and thereby acts directly on this mechanism.

According to a feature, at least one part of the second actuator covers a part of the first actuator, and thus the second actuator is likewise capable of acting on the first mechanism via the first actuator.

According to another feature, the second actuator is closer to a zone of the lighter in which a flame is generated than is the first actuator, which makes access to it more difficult than access to the first actuator for an unauthorized user such as a child.

According to a feature, the second actuator has smaller dimensions than those of the first actuator. Thus when, in addition to this feature, the second actuator is closer to a zone of the lighter in which a flame is generated than is the first actuator, the safety of such a lighter is increased.

In the first embodiment, one of the actuators, designated peripheral, at least partly encloses the other actuator, designated central.

In this embodiment, the peripheral actuator contains an inner peripheral edge and the central actuator contains an outer peripheral edge covering the said inner peripheral edge in such a way that the second actuator is likewise capable of acting on the first mechanism.

According to a variant embodiment, the two actuators are arranged side by side.

According to a feature, the two actuators are kept in transverse contact with each other via a fitting of the tenon-mortise type which allows a movement of one relative to the other along the longitudinal axis XX'. For example, the fitting of the tenon-mortise type is in the form of a dovetail.

According to a second embodiment in which the two actuators are independent of each other in their axial movement, the second actuator is solely capable of acting on the second mechanism, which also ensures functional independence of the two actuators.

In this embodiment, it is thus necessary to press simultaneously on the two actuators to operate the lighter according to the invention, operation which is beyond the scope of a child.

The functional independence of the actuators makes for increased safety compared with solely independence of movement of the actuators.

BRIEF DESCRIPTION OF THE DRAWINGS

Other features and advantages will appear during the following description, which is provided solely by way of non-limiting example and with reference to the drawings, in which.

DESCRIPTION OF THE PREFERRED EMBODIMENTS

Figure 1:
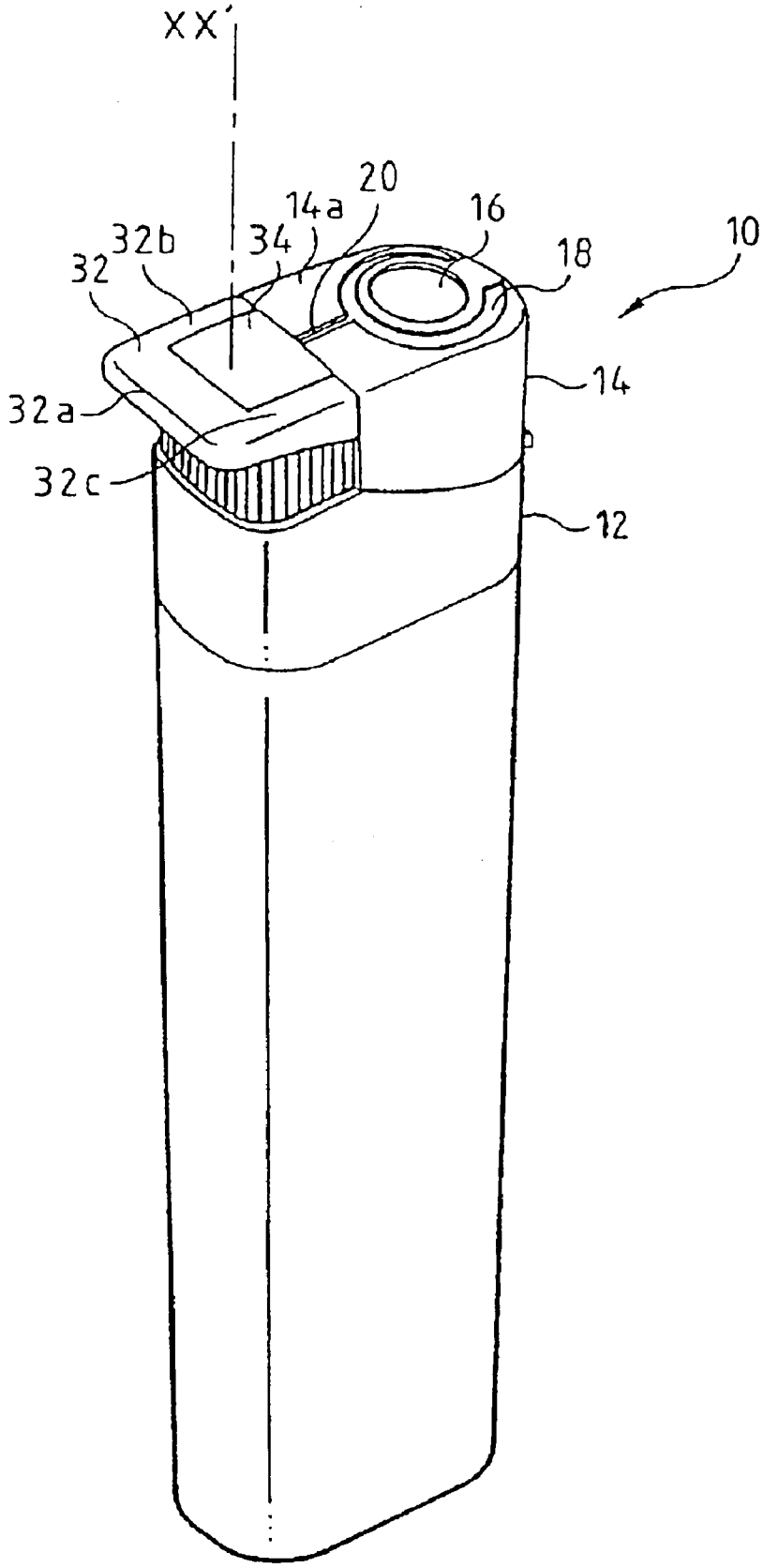
FIG. 1 is a general schematic view representing a lighter according to a first embodiment of the invention.

As represented in FIG. 1 and indicated by the general reference number 10, a lighter according to the invention has a body 12 of elongated general shape.

The lighter also contains in the upper part of the body a piece, generally of metal, numbered 14, forming a windshield in order to protect a flame generated by the lighter and which crosses an upper face 14*a* of the piece 14.

More particularly, the face 14*a* has been pierced so as to free, on the one hand, a circular orifice numbered 16 and, on the other, over almost all of its periphery, a groove forming a semi-circular ring 18.

This ring 18 extends in the form of a rectilinear groove 20 in the direction opposite to that of the circular orifice 16.

Figure 2:
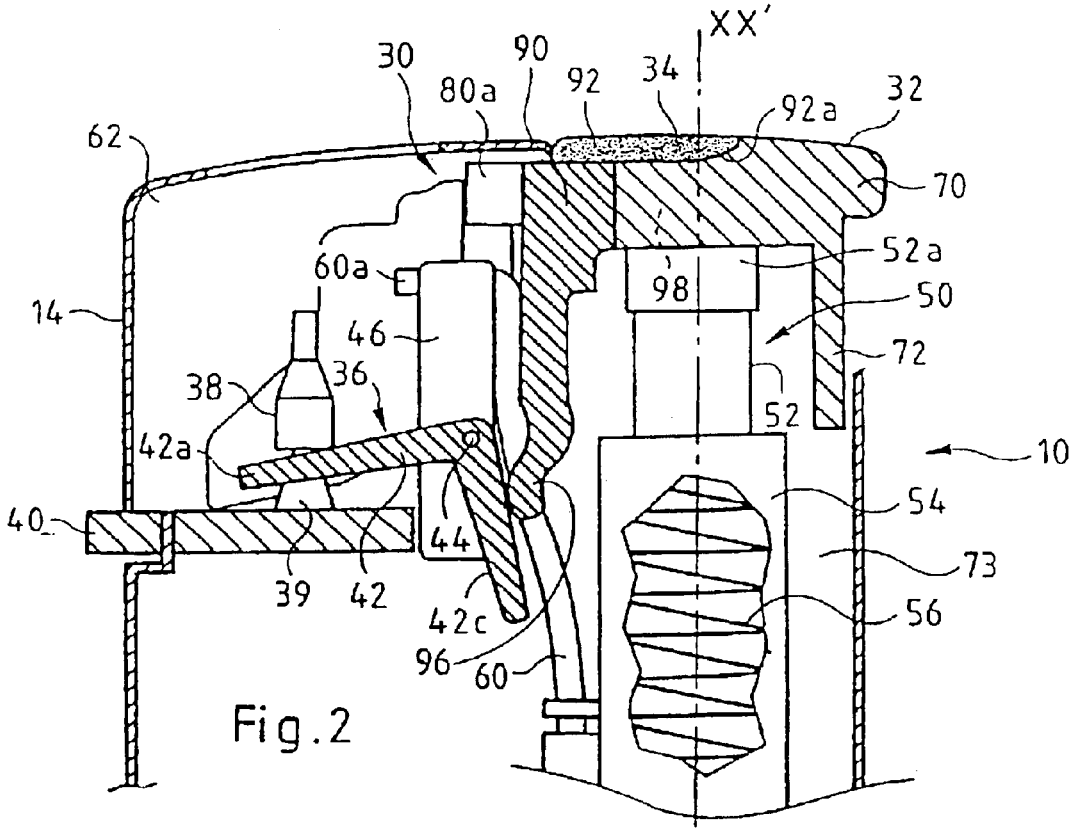
FIG. 2 is a partial schematic view in longitudinal section of the lighter represented in FIG. 1.

The lighter according to a first embodiment of the invention includes a flame-generation device, numbered 30 in FIG. 2 and including two actuators 32 and 34 which are represented, in FIG. 1, in the top part of the body 12 of the lighter.

As represented in FIG. 1, the first actuator 32, designated peripheral, partially encloses the second actuator 34, designated central actuator.

It should be noted that the first actuator could of course completely enclose the second actuator, by way of a variant.

Figure 9:
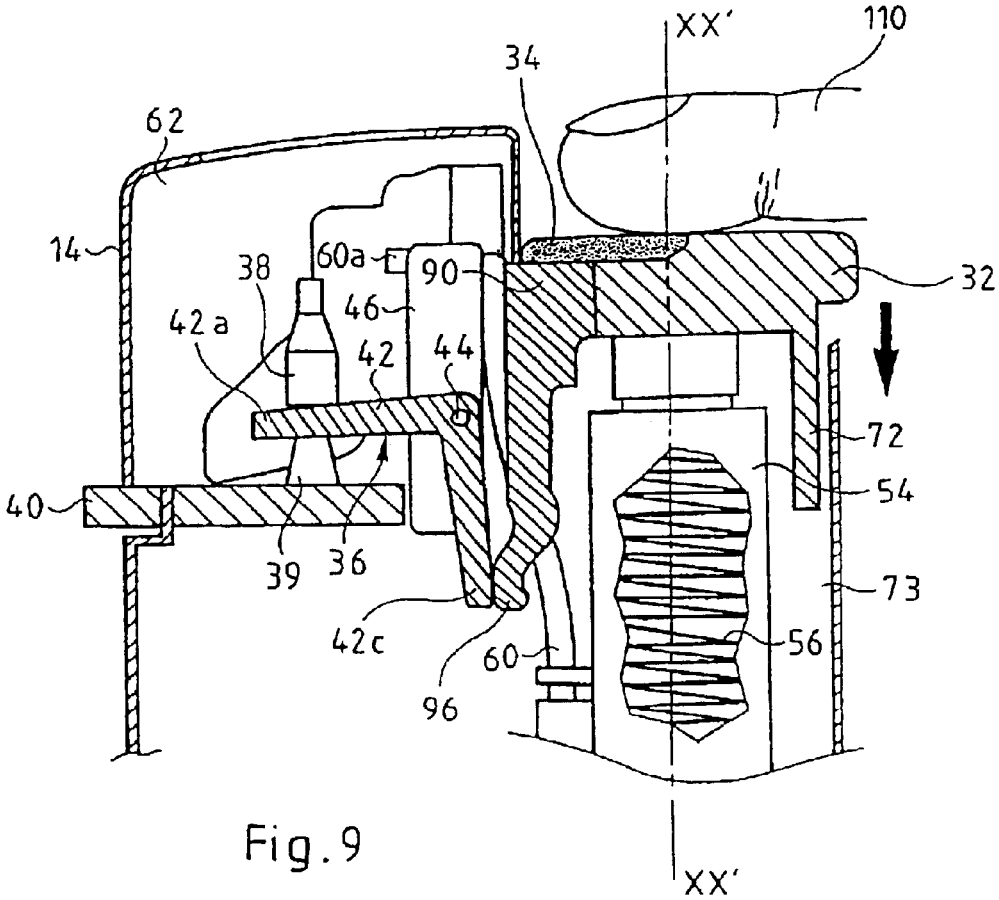
FIG. 9 is a schematic view of the lighter represented in FIG. 1 when being operated by an authorized user.

The two actuators are each capable of moving along a longitudinal axis XX' under the action of a force exerted by a user along this axis, as shown in FIG. 9 which will be described later.

It will be seen that in the normal-use position the lighter is placed in a vertical position as indicated in the Figures.

The flame-generation device 30 contains a mechanism 36 releasing a jet of gas.

The mechanism releasing a jet of gas includes an organ, numbered 38, releasing a jet of gas, which is, for example, in the form of a nozzle connected to a gas-filled vessel (not shown in the drawings) in a manner known to a person skilled in the art. The vessel is placed underneath a horizontal surface 40 on which the nozzle 38 is mounted.

The mechanism 36 also contains a piece 42 the section of which is in the form of an L-iron, as shown in FIG. 2, and which is articulated about an axis 44 crossing an upright 46 fitted perpendicular to the surface 40.

The piece 42 forms a lever and has, at one of its ends, two arms 42*a* and 42*b* (FIG. 3) gripping a conduit 39 placed under the valve of the nozzle and leading the gas to the latter. The piece 42 forming a lever also contains, at its opposite end, two legs 42*c* and 42*d* (only part of leg 42*d* is visible in FIG. 3) which are intended to co-operate as will be seen later with a part of the second actuator 34.

When this operation has taken place the piece 42 pivots about its axis 44, which allows it to raise the valve of the nozzle 38 and thus release a jet of gas (FIG. 9).

Figure 10:
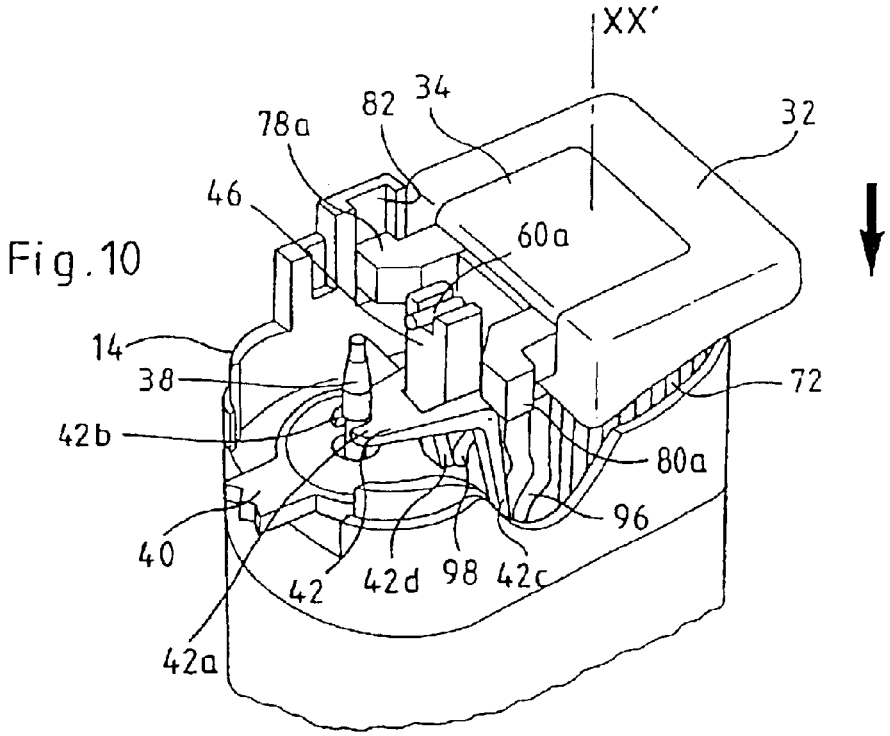
FIG. 10 is a partial schematic view showing the interior of the lighter of FIG. 9.

In the position shown in FIGS. 9 and 10 the device 30 is actuated so as to generate a flame.

The flame-generation device 30 also includes a piezoelectric spark-generation mechanism, numbered 50.

This mechanism 50, known to a person skilled in the art, is in the form of an element 52 having an essentially cylindrical shape (FIG. 2) sliding inside a cylindrical sleeve 54 in the inside of which is located in particular a spring 56. The spring exerts an ascending force so as to keep the element 52 in the upper position when no force is exerted by the user on the actuators or at least on the actuator 32.

The lighter operates in accordance with the known principle of the piezoelectric effect, according to which a piezoelectric element, such as for example a crystal, placed at the bottom of the sleeve 54 (not shown), is struck by an element forming a hammer in order to produce an electric spark.

The end (not shown in the Figures) of the cylindrical element 52 which is opposite the end 52*a* which is seen in FIG. 2 and which is in contact with the actuators 32 and 34 forms a hammer which strikes the aforementioned piezoelectric element when the said cylindrical element 52 is moved downwards, along axis XX', under the action of a force exerted by the finger of a user on the actuators.

In the position shown in FIG. 2, the device 30 is not activated so as to generate a flame.

The device 30 also contains an electric conductor 60 by which a spark produced by the aforementioned piezoelectric mechanism is propagated.

The electric conductor 60 is electrically connected in known manner to the aforementioned mechanism by one of its ends located in the lower part of the drawing of FIG. 2 but not shown.

The conductor 60 opens at its opposite end 60*a* (FIGS. 2 and 3) into what is called a combustion chamber 62 which is housed inside the piece forming a screen 14 and into which the aforementioned nozzle 38 releasing the jet of gas also opens.

It should be noted that when the mechanism releasing a jet of gas is activated as mentioned above and the spark-generation mechanism has also been activated, the nozzle 38 is in a position raised to the height of the debouching end 60*a* of the electric conductor 60 at the level of which the spark is found which has just been generated and the said nozzle releases a jet of gas, thus allowing the generation of a flame.

Figure 3:
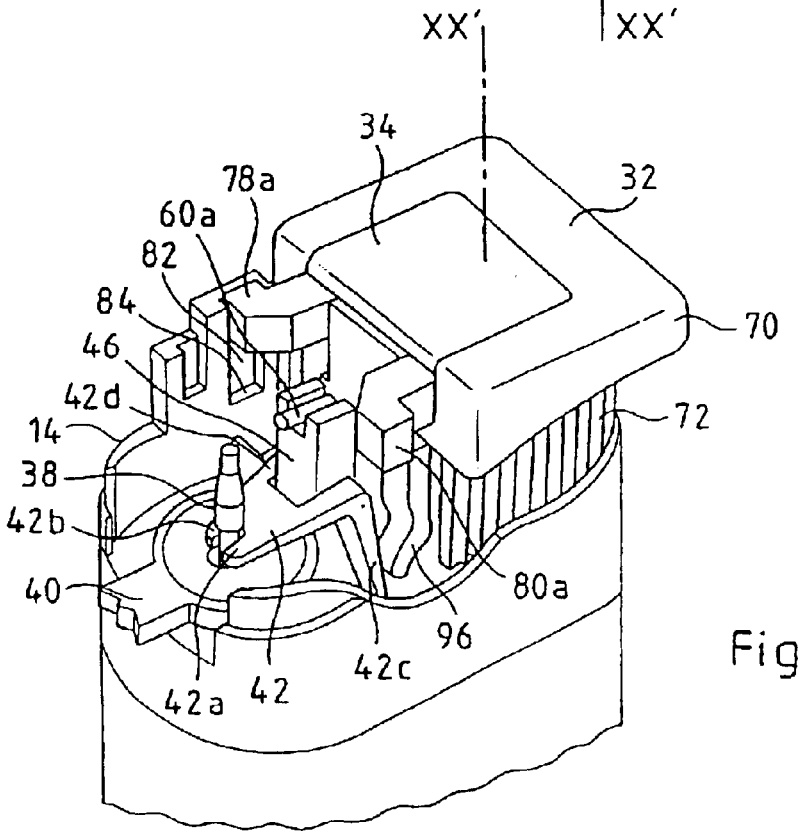
FIG. 3 is a schematic perspective view showing part of the interior of the lighter of FIG. 2.

As shown in FIGS. 1 to 3, the two actuators each have what is called a contact face which is intended to receive the finger of a user. The contact faces are located in the same axial position along the longitudinal axis XX', as shown in FIG. 2, when no force is exerted by the user on one and/or the other of these said faces.

In the representation which has been made in FIGS. 1 to 10, the central second actuator 34 is placed closer to the openings 16 and 18 (FIG. 1), across which the flame generated by the lighter passes, than is the peripheral first actuator 32.

Generally speaking, it is thus seen that the finger of an unauthorized user of the lighter, such as a child, will first touch the more accessible actuator, that is to say the peripheral first actuator, and not the central second actuator which is located between the said first actuator and the zone from which the flame generated by the lighter emerges.

In this embodiment, the first actuator 32 encloses the second actuator 34 on three sides in order that, even if the unauthorized user, such as for example a child, who naturally presses his finger close to the edge of a piece rather than in the centre of the latter, does not press his finger on the end-part 32*a* (FIG. 1) of the first actuator but on the side-parts 32*b* and 32*c* of the latter, then this user will not have access to the second actuator 34.

This is all the more true since a child's fingers are generally smaller than those of an adult and thus, in pressing on the edge of a piece with his finger, a child has less chance than an adult of simultaneously pressing on the centre of this piece.

Such an arrangement of the two actuators thus offers a high degree of safety, as will be seen in the description that follows.

Figure 4:
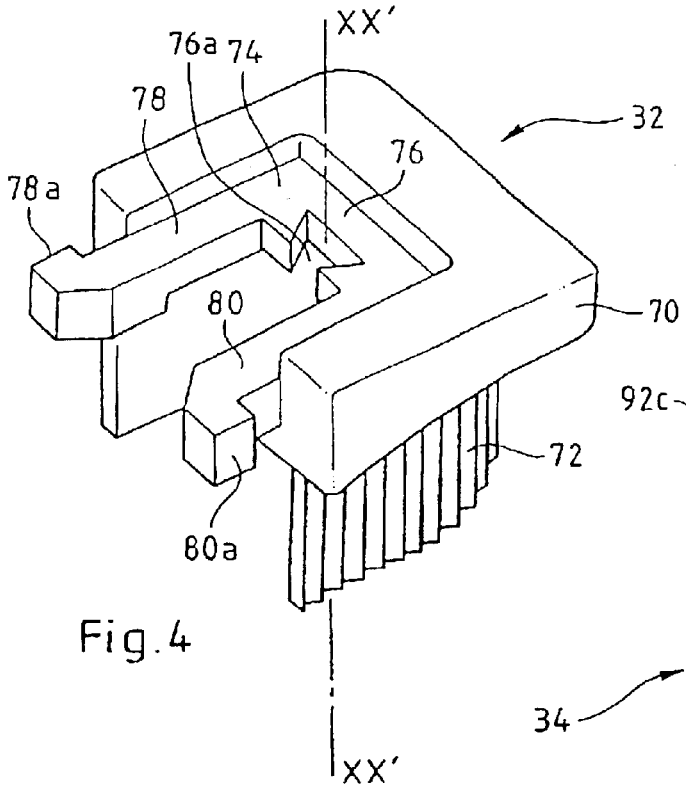
FIG. 4 is a perspective view of the first actuator used in the lighter of FIGS. 1 to 3.

As shown in FIG. 4, the peripheral first actuator 32 contains an upper part 70 forming a head the upper face of which forms the contact face of the actuator and a lower part 72 forming a longitudinal skirt which extends round the cylindrical element 52 when the actuator is placed in the lighter.

The first actuator 32 is hollow so as to be able to receive the second actuator 34 in the inside of same and to this end contains, in its inside part, a piece 74 generally having a U-shape and the opening of which is turned towards the outside of the said actuator.

The skirt 72 is inserted in a peripheral space 73 (FIG. 2) enclosing the cylindrical element 52, during the downward longitudinal movement of the actuators.

The piece 74 is situated slightly set back along the axis XX' relative to the axial position of the contact face of the said actuator.

When the first actuator is placed in the lighter (FIG. 3) the opening of the piece 74 is directed towards the zone from which the flame generated by the lighter emerges.

This piece 74 forms an inner peripheral edge.

This piece 74 has a base 76 from which there extend two arms 78 and 80, the ends of which project out from the actuator and are fitted respectively with two shoulders 78*a* and 80*a* turned in opposite directions.

As shown in FIG. 3, each of the shoulders 78*a* and 80*a* fits into a corresponding groove of the surface of the piece 14 forming a screen.

Thus, in FIG. 3 the shoulder 78*a* fits into the groove 82 and is intended, during the longitudinal movement of the actuator, to slide in the inside of this groove.

Its movement is limited by the presence of a stop 84 provided at the bottom of the groove.

Returning to FIG. 4, the base 76 of the piece 74 has a hollowed-out section 76*a* in the form of a dovetail intended to receive a part of complementary shape as will be seen later.

As shown in FIG. 2, the first actuator 32 rests on the upper end 52*a* of the cylindrical element 52 of the spark-generation mechanism 50, called first mechanism for the purposes of the present invention.

This support is realized by means of the piece 74 described above.

Figure 5A:
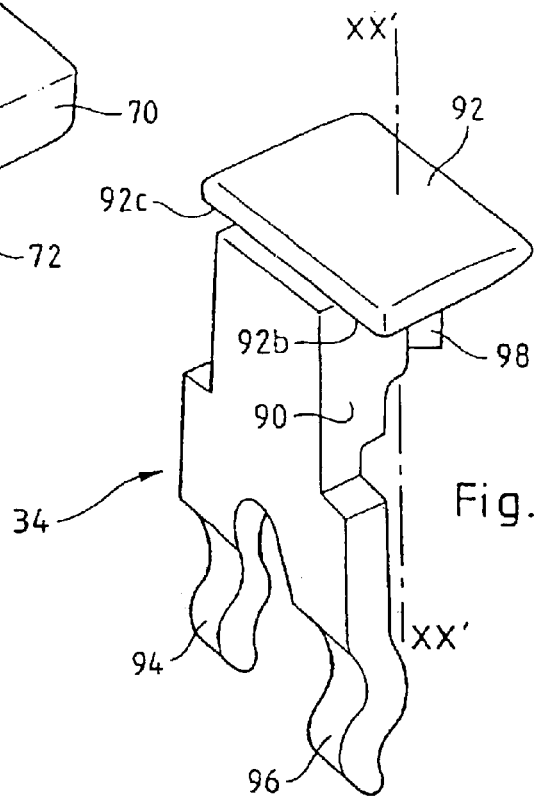
FIG. 5*a* is a schematic perspective view of the second actuator used in the lighter represented in FIGS. 1 to 3.
Figure 5C:
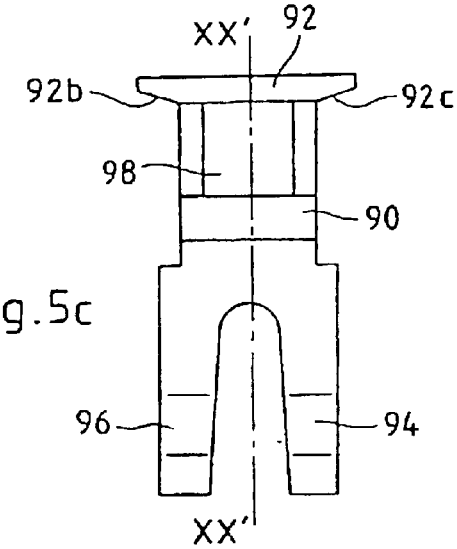
FIG. 5*c* is a schematic end-view of the second actuator of FIG. 5*a;*
Figure 5B:
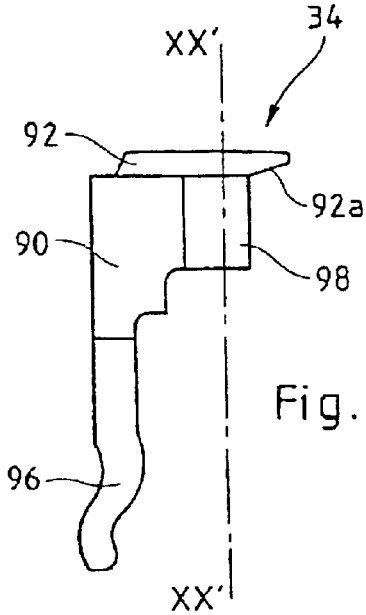
FIG. 5*b* is a schematic side view of the second actuator of FIG. 5*a;*

As shown in FIGS. 5*a*, 5*b* and 5*c*, the central second actuator 34 has a body 90 surmounted by a head 92 the upper face of which forms the contact face of the actuator and which is provided with two parts forming legs 94 and 96 extending downwards. The legs 94 and 96 come to rest respectively on the legs 42*c* and 42*d* of the piece forming a lever 42 of the mechanism releasing a jet of gas, called second mechanism for the purposes of the present invention. Only the legs 96 and 42*c* are shown in FIGS. 2 and 3.

It should be noted that the curved form of the legs 94 and 96 of the second actuator allows an increase in their resistance to wear during the repeated downward and upward movements and contacts of the said legs with the legs 42*c* and 42*d* of the piece forming a lever 42.

The body 90 of the actuator also has a trapezoidal part 98, the small side of the trapezium of which is in contact with the body.

This trapezoidal part 98 is intended to be inserted into the dovetail-shaped hollowed-out section 78 of the piece 74.

In this way, the two actuators 32 and 34 are kept in transverse contact with each other through the co-operation of the parts 76*a* and 98 of the said actuators. It should be noted that any other fitting of the tenon-mortise type can also be used to make the two actuators transversely integral while allowing them the possibility of moving longitudinally relative to each other.

When the central second actuator 34 is placed inside the peripheral first actuator 32 (FIG. 3), part of the second actuator covers the U-shaped piece 74 of the first actuator which forms an inner peripheral edge of the latter and which is intended to provide a support for the second actuator.

More particularly, the part of the second actuator which covers the piece 74 of the first actuator consists of the lower faces, frontal 92*a* and lateral 92*b*, 92*c* of the head 92 of the said actuator (FIGS. 5*b* and 5*c*).

It will be noted that the faces which are in contact during this partial covering, both for the first actuator and for the second actuator, are inclined although this is not necessarily apparent in the Figures.

It should however be noted that this inclination is not strictly necessary to allow the realization of the lighter according to the invention.

Given that the second actuator rests through its trapezoidal part 98 on the upper end face 52*a* of the longitudinal element 52, the second actuator is thus likewise capable of acting directly on the spark-generation mechanism 50.

By its nature, the second actuator 34 acts on the mechanism 36 releasing a jet of gas, as was explained above.

The description which follows with reference to FIGS. 6 to 10 will allow the advantages associated with the present invention to be highlighted.

Figure 6:
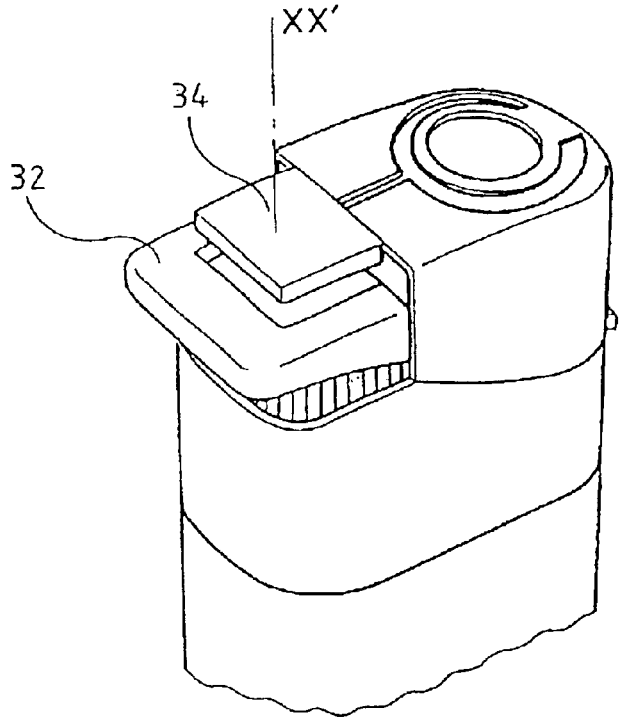
FIG. 6 is a partial schematic view of the lighter of FIG. 1 when being operated by an unauthorized user.
Figure 7:
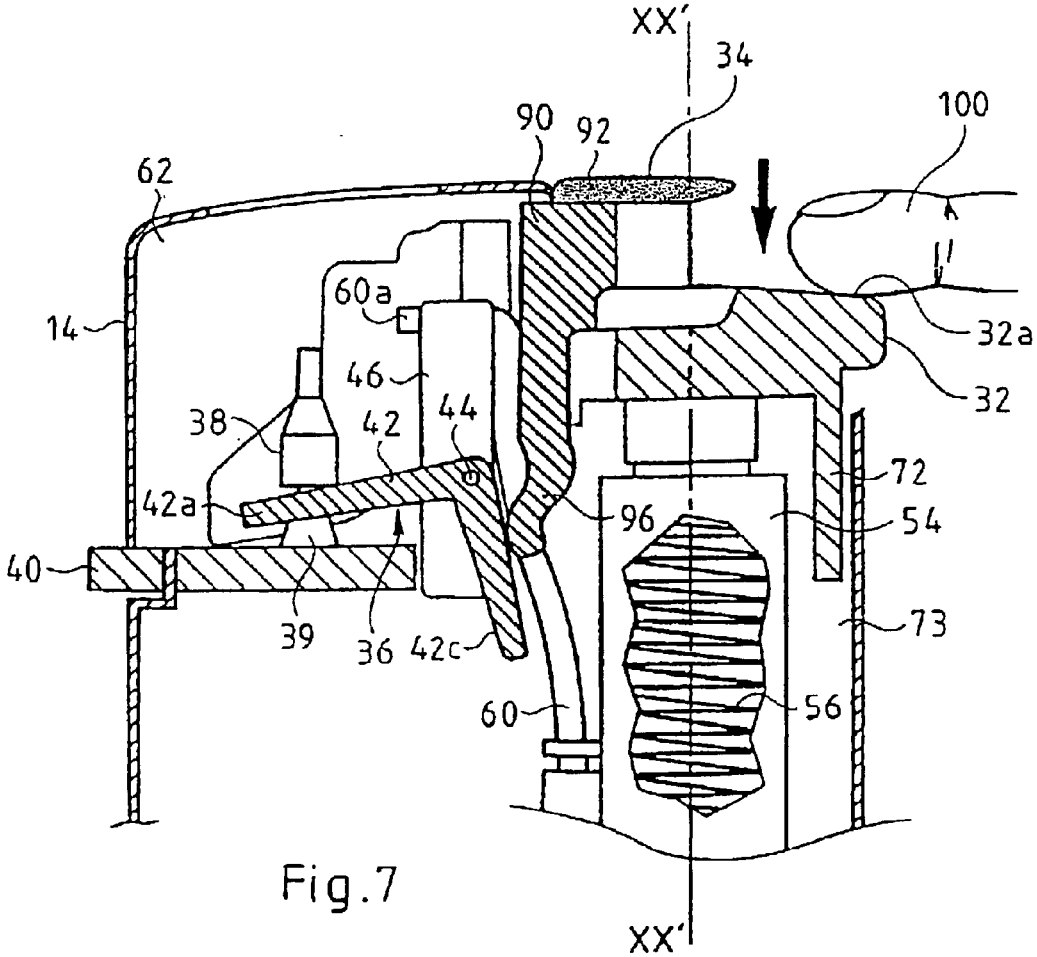
FIG. 7 is a partial schematic view in longitudinal section of the lighter of FIG. 6.
Figure 8:
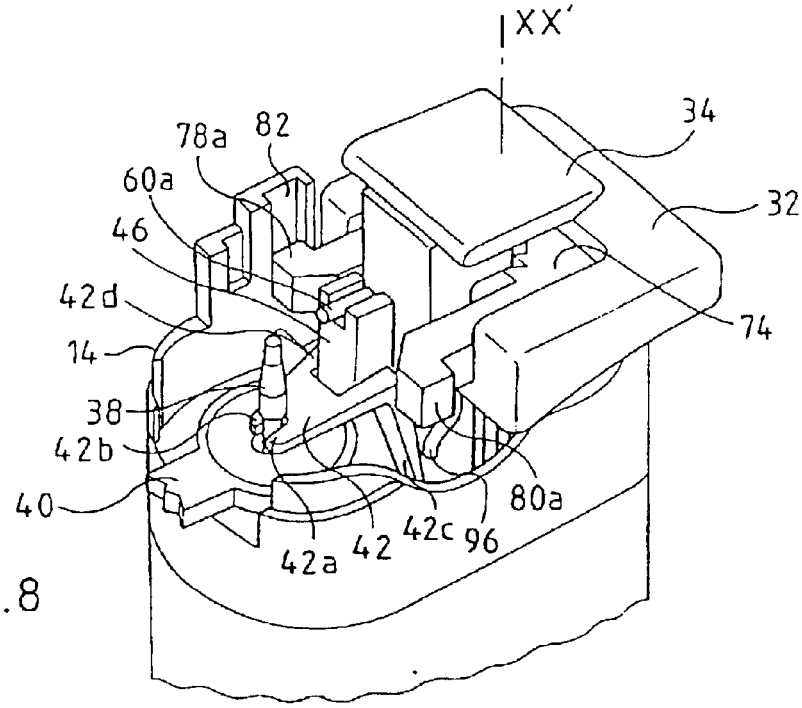
FIG. 8 is a partial schematic view showing the interior of the lighter of FIG. 6.

As shown in FIGS. 6 to 8, when a child places his finger, numbered 100 (FIG. 7), on the part of the lighter containing the actuators, he will quite naturally, as pointed out above, place his finger close to the edge of the lighter, which proves to be the edge of the first actuator 32, on the part 32*a*.

Because a child's fingers are smaller than those of an adult, the second actuator 34 will not be accessible to him and, by pushing downwards along the axis XX', as indicated by the downward-pointing arrow in FIG. 7, the child will succeed in activating only the spark-generation mechanism 50 (first mechanism), but not the mechanism 36 releasing a jet of gas (second mechanism).

This is made possible by the fact that the first actuator 32 is capable of moving along the longitudinal axis XX' independently of the second actuator 34.

As shown in FIG. 8, it will be noted that when the spark-generation mechanism 50 is activated, the shoulder 78*a* of the piece 74 of the first actuator 32 is in contact with the stop 84 shown in FIG. 3.

On each of FIGS. 6 to 8 it will also be noted that, as the second actuator 34 has not been touched by the unauthorized user, it remains in the inactivated position and thus does not act on the mechanism releasing a jet of gas.

It should be noted that, for the unauthorized user, the difficulty of access to this central second actuator 34 can be increased if the dimensions of the said actuator are reduced vis-à-vis those of the first actuator 32.

As shown in FIGS. 9 and 10, when the normal user of the lighter according to the invention, an adult, rests his finger, numbered 110 on FIG. 9, on the part of the lighter where the actuators are situated, it simultaneously covers the first and second actuators 32 and 34. Thus, by pushing in the direction indicated by the downward-pointing arrow in FIGS. 9 and 10, the authorized user moves the said actuators longitudinally along the axis XX', and they act on the mechanisms generating a spark and releasing a jet of gas.

It will be noted that, by pushing vertically downwards on just the second actuator 34, the first actuator 32 is also moved.

During this movement, the first actuator 32 exerts its action solely on the spark-generation mechanism 50 by pressing on the cylindrical element 52, whilst the second actuator 34 simultaneously exerts an action on this spark-generation mechanism 50, and on the mechanism 36 releasing a jet of gas 36.

Upon the downward movement of the actuator 34, the latter rests on the piece 74 and on the cylindrical element 52 and the legs 94 and 96 of the said second actuator exert a force respectively on the legs 42*d* and 42*c* of the piece 42 forming a lever, thus causing it to pivot about the axis 44, which leads, as was seen above, to the release of a jet of gas.

When the user stops pushing on the actuators, the spring 56 (FIG. 2) extends to push the cylindrical element 52 upwards and return the said actuators to their initial position as shown in FIG. 2.

Figure 11:
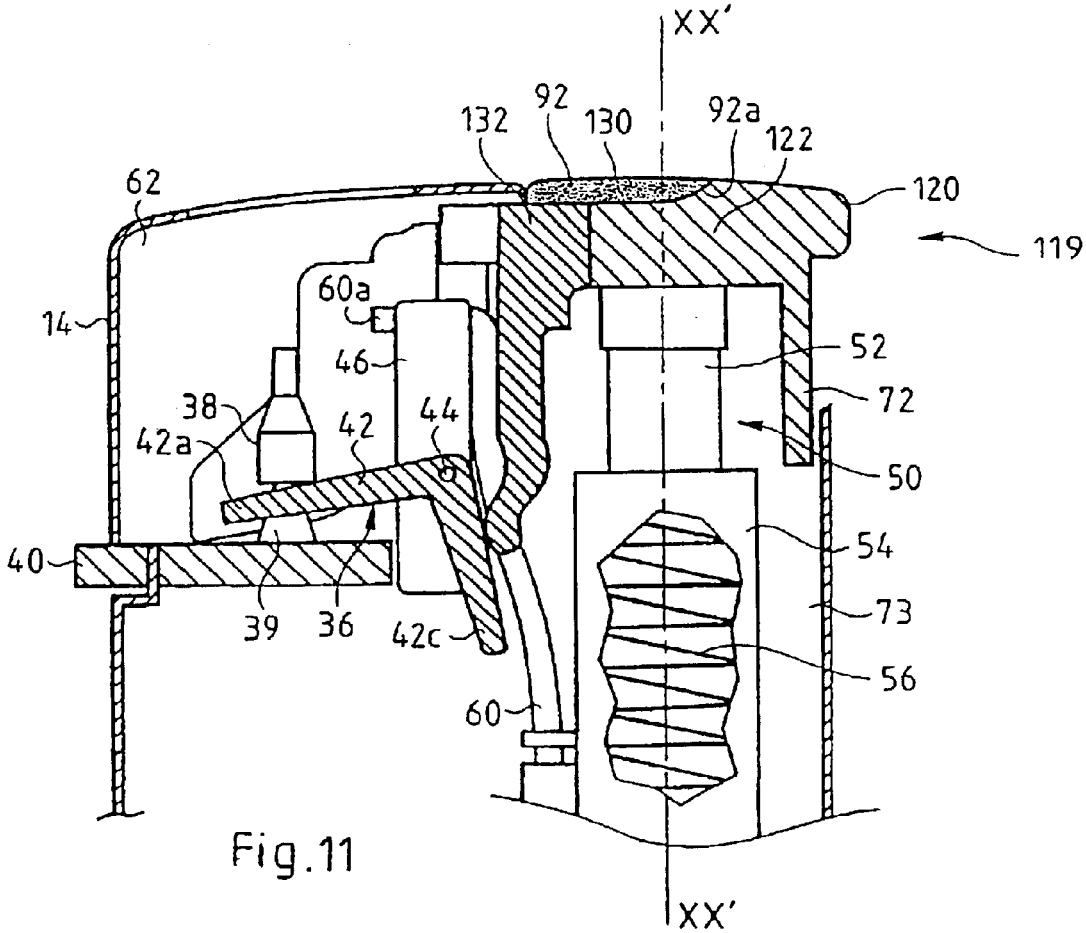
FIG. 11 represents a first variant embodiment of the lighter of FIG. 2.

According to a variant shown in FIG. 11, in a lighter 119 the first actuator 120 is still capable of moving independently of the second actuator 130 along the longitudinal axis XX', but remains the only one capable of acting directly on the spark-generation mechanism 50. This first actuator has a head 122 which rests on the whole of the end-face of the upper end 52*a* of the cylindrical element 52.

In this variant, the second actuator 130 still covers part of the first actuator 120 with part of its head 92 as indicated above with reference to the previous figures, but no longer rests directly on the spark-generation mechanism as was previously the case.

It will however be noted that in this variant the second actuator 130 nevertheless remains capable of indirectly acting on the spark-generation mechanism 50 because it rests on the first actuator 120.

It should however be noted that in this variant embodiment the fitting of the tenon-mortise type in the form of a dovetail, described previously, is reversed. Thus, the projecting trapezoidal part is integral with the piece 74 of the first actuator, whilst the dovetail-shaped complementary hollowed-out section is worked in the body 132 of the second actuator.

Everything which was said above with reference to FIGS. 1 to 10 remains valid unless otherwise stated. The elements which remain unchanged in this variant embodiment keep the same reference numbers as used previously.

Figure 12:
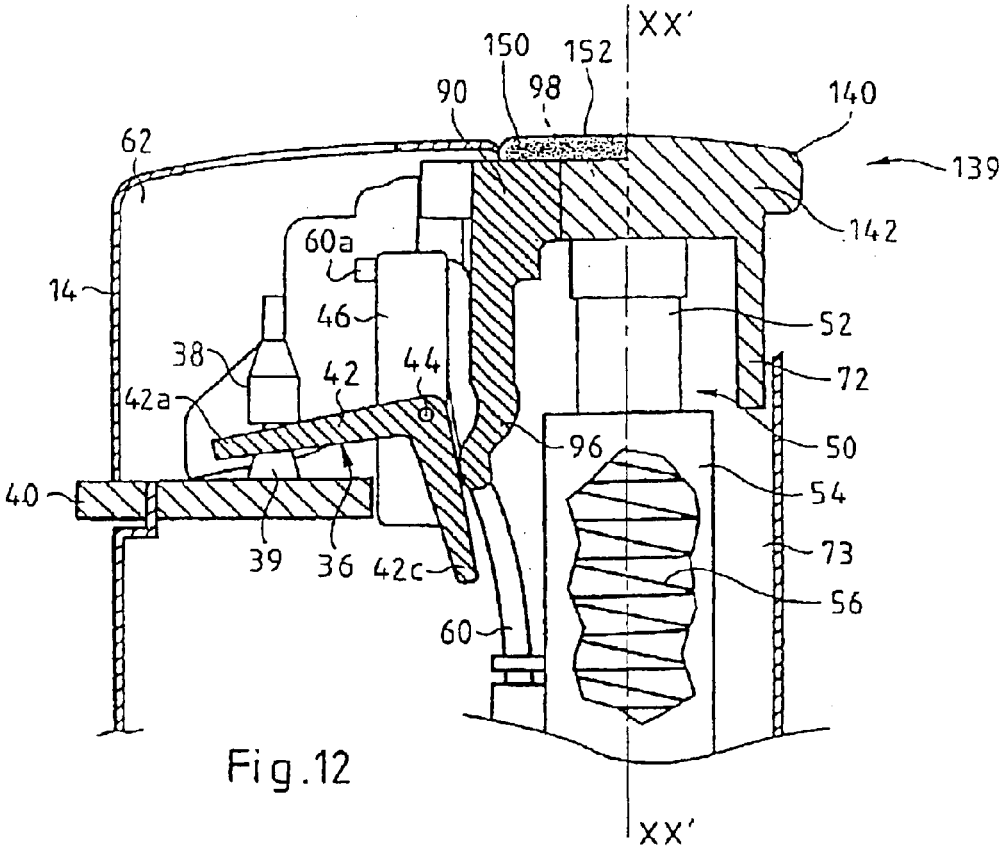
FIG. 12 represents a second variant embodiment of the lighter of FIG. 2.

FIG. 12 illustrates a second variant embodiment of a lighter 139 in which the first actuator 140 still has a head 142 resting on the cylindrical element 52 of the spark-generation mechanism 50.

The second actuator 150 for its part still rests, as shown in FIG. 2, on the upper part of the cylindrical element 52 in order to act directly on the mechanism 50 but its head 152 no longer covers part of the first actuator 140.

Thus, in this variant, the two actuators 140 and 152 are totally independent of each other in their axial movement.

In an identical manner to what was indicated with reference to FIGS. 1 to 10, a child using the lighter of this variant embodiment would press only on the first actuator 140 and would thus operate only the spark-generation mechanism, but not the mechanism releasing a jet of gas, given that he would not succeed in reaching the second actuator 150. Given that the second actuator 150 no longer covers part of the first actuator 140, the dimensions of the second actuator have thus been able to be reduced vis-à-vis those of the first actuator, which, as indicated previously, makes it more difficult to operate for an unauthorized user such as a child.

However, an adult will simply operate such a lighter by pressing solely on the second actuator 150 or simultaneously on the two actuators 140 and 150.

It should be noted that the lighter according to the invention, in all its embodiments, is advantageous vis-à-vis the lighters of the state of the art inasmuch as the safety mechanism inherent in this lighter does not question the customary practices of a normal user of the lighter.

In fact the normal user, as in the past, simply has to exert a downward axial pressure on one and/or the other of the actuators (according to the embodiments of the invention) in order to operate the lighter.

What was said above during the description relating to FIGS. 1 to 10 remains valid for this variant embodiment (FIG. 12) insofar as what has been specified when describing this variant does not contradict the previous descriptions.

In the same way, the previous reference numbers remain unchanged for those elements which are not modified in this variant.

Figure 13:
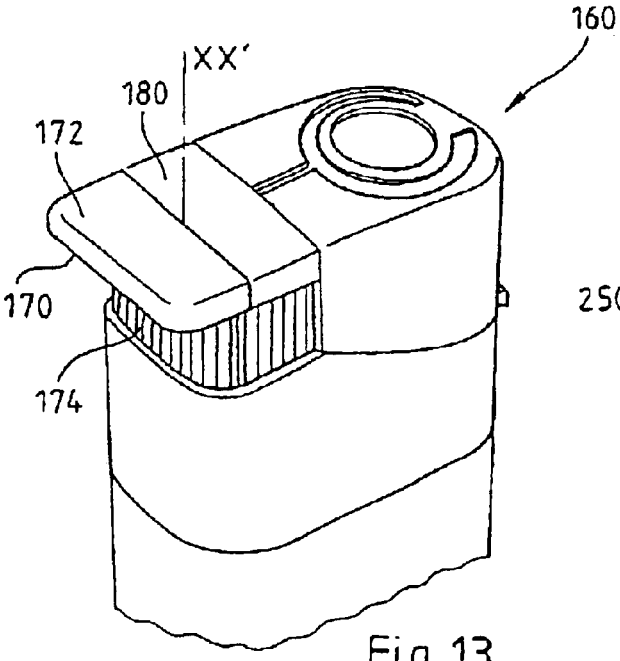
FIG. 13 is a partial schematic view of a third variant embodiment of the lighter of FIG. 1.
Figure 14:
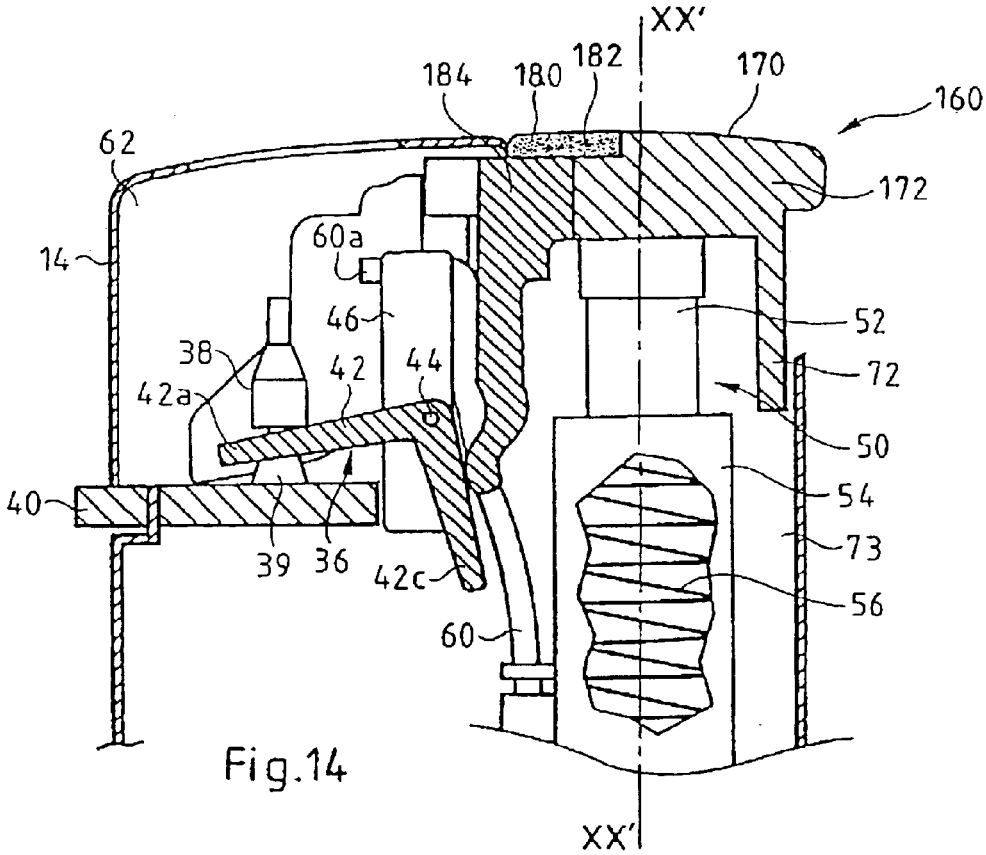
FIG. 14 is a partial schematic view in longitudinal section of the lighter of FIG. 13.

FIGS. 13 and 14 illustrate a third variant embodiment in which a lighter 160 contains two actuators 170 and 180 which are arranged side by side and no longer with one around the other.

As shown in FIG. 14, the first actuator 170 has a head 172 which rests on the cylindrical element 52 of the spark-generation mechanism 50, as indicated in the variant embodiment shown in FIG. 11.

It will also be noted that the second actuator which is capable of acting simultan-eously on the mechanism releasing a jet of gas and on the spark-generation mechanism, via the first actuator, is arranged between the zone where the flame is generated and the first actuator which proves to be the more easily accessible actuator for a user such as a child.

In the same way as in the variant of FIG. 11, the second actuator 180 has a head 182 which covers a part of the first actuator 170 but the dimensions of which are reduced compared with the head 92 of the second actuator 130 of FIG. 11.

This increases the reliability of the safety mechanism vis-à-vis unauthorized users such as children, since the second actuator is even less easily accessible than before.

The second actuator 180 also has a body 184 which, as in the variant of FIG. 11, has an inner hollowed-out section in the form of a dovetail intended to receive an integral complementary trapezoidal part of the piece 74 of the first actuator 170.

The normal user will press on the two actuators in order to operate the lighter according to the invention, but he could press on only the second actuator in order to achieve the same object.

Everything which was said above with reference to the various embodiments remains valid insofar as there is no contradiction with the description that has been given with regard to FIGS. 13 and 14.

Figure 15:
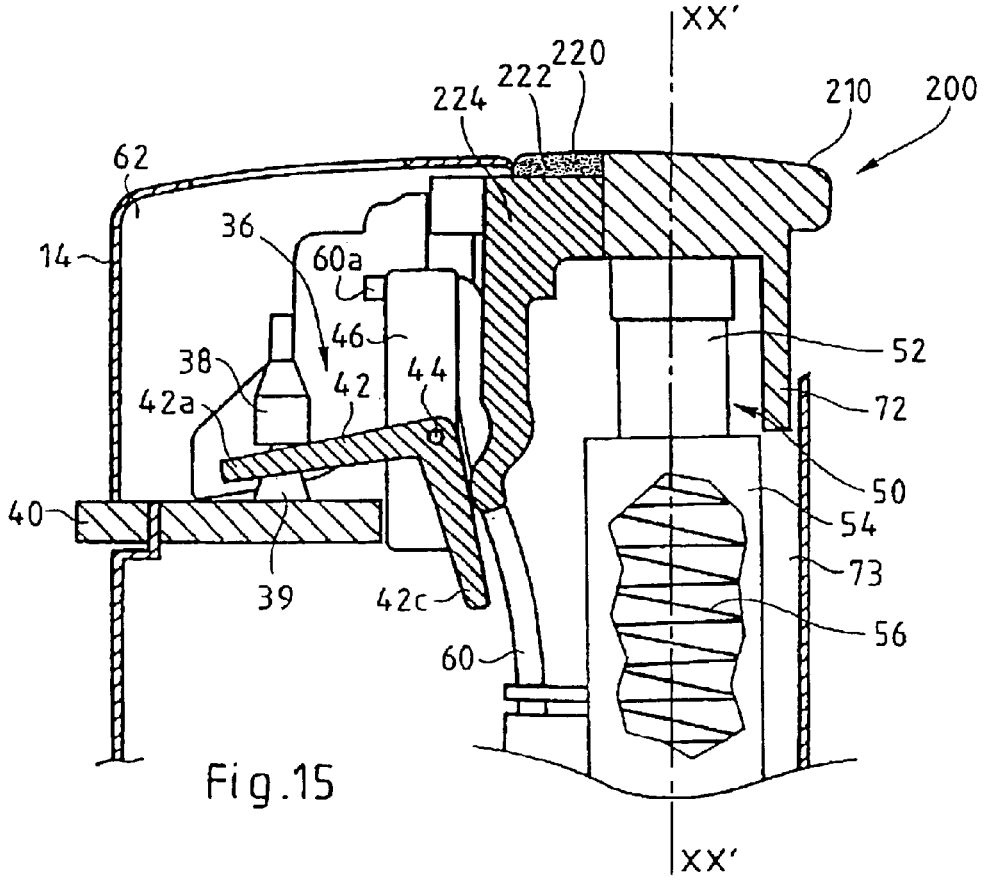
FIG. 15 is a schematic view in partial longitudinal section analogous to that of FIG. 2 of a lighter according to a second embodiment.

FIG. 15 illustrates a second embodiment of the invention in which the lighter 200 contains two actuators 210 and 220 which are independent of each other in their axial movement since here the second actuator, numbered 220, does not cover part of the first actuator 210.

Moreover, the first actuator 210 has a head which alone rests on the spark-generation mechanism 50, via the cylindrical element 52.

The second actuator 220 has a head 222 whose dimensions are reduced compared with those of the head 182 of the second actuator 180 of FIGS. 13 and 14, a feature which offers increased safety.

The second actuator 220 also has a body 224 identical to the body 184 of the second actuator of FIGS. 13 and 14.

Thus, the two actuators are likewise functionally independent, as the first actuator 210 is solely able to act on the spark-generation mechanism, whilst the second actuator 220 is solely able to act on the mechanism releasing a jet of gas.

Figure 16:
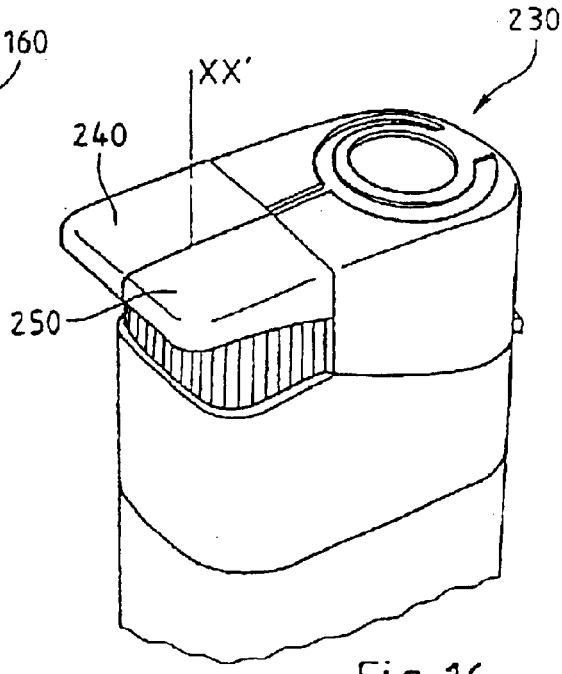
FIG. 16 is a partial schematic view in perspective of the lighter of FIG. 15 according to a variant.

It will be noted that in this embodiment the second actuator 220 is brought into its initial position shown in FIG. 16 by an elastic system such as a spring (not shown).

It will be noted that this embodiment offers even greater safety vis-à-vis unauthorized users such as children, given that, in order to operate the lighter, it is necessary to press simultaneously on the two actuators and no longer on just one as previously.

FIG. 16 shows a variant embodiment of the lighter of FIG. 15 in which the two actuators of the lighter 200 have been rotated by 90° in order to both be in the same position vis-à-vis the zone from which the flame emerges.

The lighter 230 of FIG. 16 thus also contains two actuators 240 and 250 arranged side by side and each placed at an equal distance relative to the zone from which the flame generated by the lighter comes.

In a similar manner to the lighter of FIG. 15, each of the two actuators acts in isolation on a single mechanism among the spark-generation mechanisms and those releasing a jet of gas, and the movement of each actuator is independent of the movement of the other actuator. It should be noted that, here again, this independence of the movements and functions of the two actuators offers an additional guarantee of safety vis-à-vis unauthorized users of the lighter.

In fact, a child will not think of pressing simultaneously on the two actuators but, on the contrary, will press one or the other.

Moreover, the risk of a child's accidentally pressing simultaneously on the two actuators is greatly reduced, given the smallness of his fingers and, quite often, the imprecision of his movements.

It will be noted that in this variant embodiment, the dimensions of one of the actuators can be reduced with respect to those of the other actuator for the sake of improved safety.

What is claimed is:

1. A piezoelectric-type lighter comprising:

a flame-generation device which includes two mechanisms, namely a mechanism releasing a jet of gas and a piezoelectric spark-generation mechanism; and two actuators that move along a longitudinal axis XX' under the action of a force exerted by a user, a first one of said two actuators moving independently of the second one of said two actuators and acting on a first one of said two mechanisms, the second one of said two actuators acting on both the first one of said two mechanisms and a second one of said two mechanisms.

2. A lighter according to claim 1, wherein the first actuator rests on the first mechanism which is the spark-generation mechanism.

3. A lighter according to claim 1, wherein the second actuator includes at least one part which rests on a piece forming a lever and which allows, under the action of a force along longitudinal axis XX', the release of a jet of gas.

4. A lighter according to 1, wherein the two actuators are independent of each other in their axial movement.

5. A lighter according to claim 1, wherein the second actuator rests on the first mechanism, which is the spark-generation mechanism.

6. A lighter according to claim 1, wherein at least one part of the second actuator covers a part of the first actuator.

7. A lighter according to claim 6, wherein one of the actuators, designated peripheral, at least partially encloses the other actuator, designated central.

8. A lighter according to claim 7, wherein the peripheral actuator has an inner peripheral edge and the central actuator has an outer peripheral edge covering the said inner peripheral edge.

9. A lighter according to claim 1, wherein the second actuator is closer to a zone of the lighter in which a flame is generated than is the first actuator.

10. A lighter according to claim 1, wherein the second actuator has dimensions which are smaller than those of the first actuator.

11. A lighter-according to claim 1, wherein the two actuators are arranged side by side.

12. A lighter according to claim 1, wherein one of the actuators, designated peripheral, at least partially encloses the other actuator, designated central.

13. A piezoelectric-type lighter comprising:

a flame-generation device which includes two mechanisms, namely a mechanism releasing a jet of gas and a piezoelectric spark-generation mechanism; and two actuators that move along a longitudinal axis under the action of a force exerted by a user, a first one of said two actuators moving independently of the second one of said two actuators and acting on a first one of said two mechanisms, the second one of said two actuators acting on a second one of said two mechanisms, wherein the two actuators are kept in transverse contact with each other via a fitting of the tenon-mortise type.

14. A lighter according to claim 13, wherein the fitting of the tenon-mortise type has a dovetail shape.

15. A piezoelectric-type lighter comprising:

a flame-generation device which includes two mechanisms, namely a mechanism releasing a jet of gas and a piezoelectric spark-generation mechanism; and two actuators that move along a longitudinal axis XX' under the action of a force exerted by a user, a first one of said two actuators moving independently of the second one of said two actuators and acting on a first one of said two mechanisms, the second one of said two actuators acting on a second one of said two mechanisms, wherein the two actuators each have a contact face for the user which are both arranged in the same position along the longitudinal axis XX' when no force is exerted on the faces.

16. A piezoelectric lighter comprising:

a first mechanism that releases a jet of gas and a second mechanism that generates a piezoelectric spark;

first and second actuators that move along a common axis under a force exerted by a user, said first actuator moving independently of said second actuator and acting on only one of said first and second mechanisms, said second actuator acting on both said first and second mechanisms.

17. The lighter of claim 16, wherein an inner edge of said first actuator abuts three sides of said second actuator.

18. The lighter of claim 16, wherein a surface of said first actuator has a depressed part in which said second actuator rests and by which said second actuator moves said first actuator when said second actuator moves.

* * * * *